United States Patent [19]

Chou et al.

[11] 4,120,609

[45] Oct. 17, 1978

[54] SHEET METAL FAN

[75] Inventors: Cheng-Chien Chou, Carmel; Clifford Sau Leong Yee, Indianapolis, both of Ind.

[73] Assignee: Wallace Murray Corporation, New York, N.Y.

[21] Appl. No.: 695,818

[22] Filed: Jun. 14, 1976

[51] Int. Cl.[2] ..... F04D 29/38

[52] U.S. Cl. ..... 416/223 R; 416/243; 416/DIG. 3

[58] Field of Search ..... 416/DIG. 2, DIG. 3, 416/223, 243

[56] References Cited

U.S. PATENT DOCUMENTS

| | | | |
|---|---|---|---|
| 1,828,258 | 10/1931 | Schmidt | 416/243 |
| 2,031,466 | 2/1936 | Criqui | 416/DIG. 3 |
| 2,468,723 | 4/1949 | Bartlett | 416/243 |
| 2,861,738 | 11/1958 | Rundle | 416/243 |
| 3,851,994 | 12/1974 | Seippel | 416/243 X |

FOREIGN PATENT DOCUMENTS

| | | | |
|---|---|---|---|
| 516,440 | 9/1955 | Canada | 416/243 |
| 711,616 | 6/1965 | Canada | 416/DIG. 2 |
| 1,428,272 | 1/1969 | Fed. Rep. of Germany | 416/243 |
| 1,940,583 | 2/1971 | Fed. Rep. of Germany | 416/DIG. 2 |
| 120,047 | 8/1970 | Norway | 416/223 |

*Primary Examiner*—Everette A. Powell, Jr.
*Attorney, Agent, or Firm*—Thomas J. Greer, Jr.

[57] ABSTRACT

A sheet metal fan blade of improved performance and efficiency has a varying camber angle and chord angle along radial positions of the blade, such that the angle of attack along at least 70% of the length of the blade is not less than 2° or more than 10°. The fan blade construction exhibits utility in an automotive radiator cooling system.

1 Claim, 9 Drawing Figures

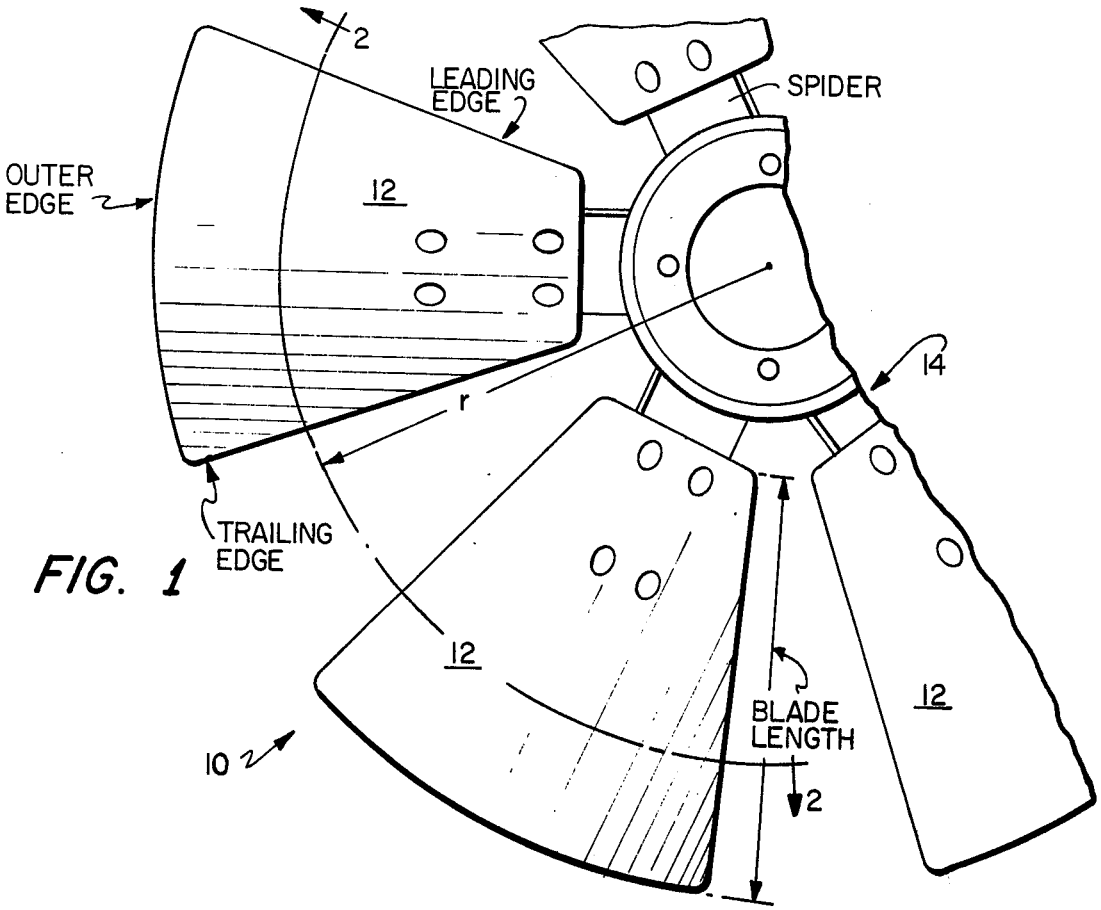
FIG. 1
FIG. 2
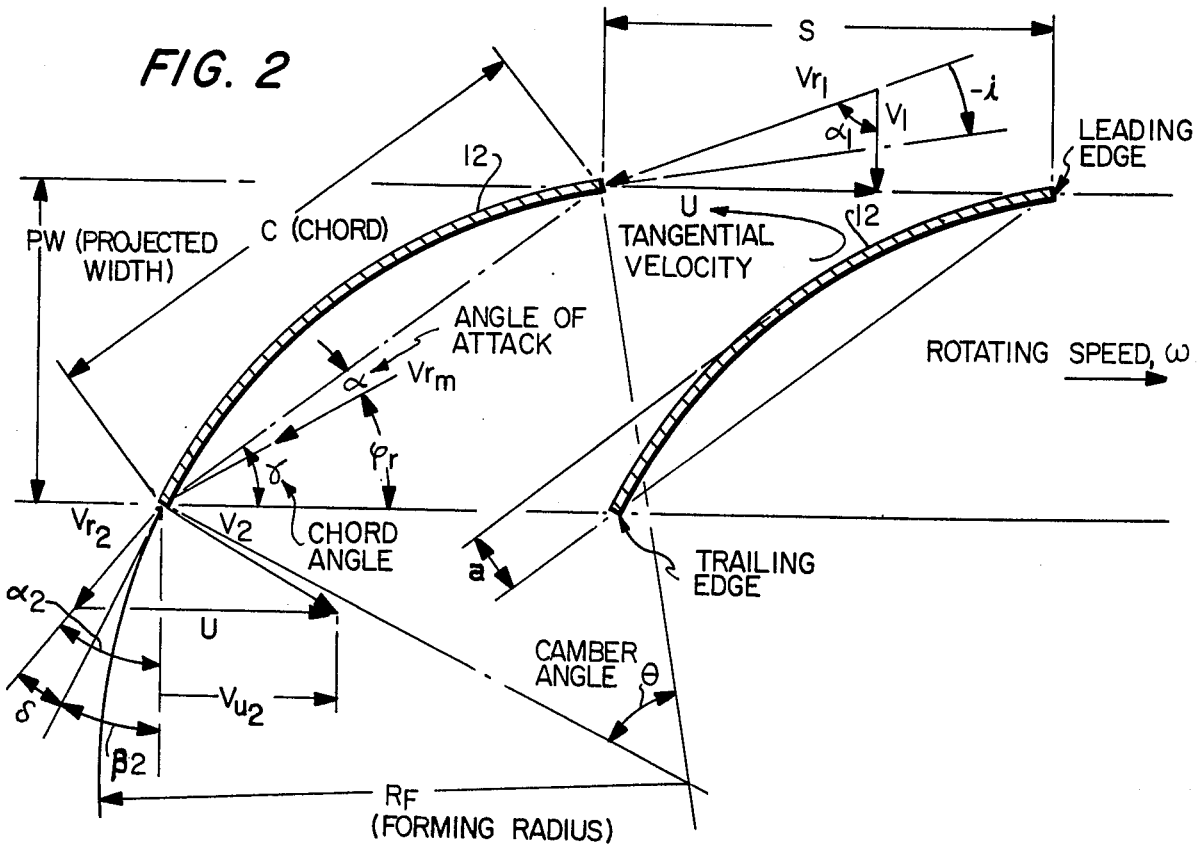

FIG. 5 — TEST COMPARISON OF FAN EFFICIENCIES
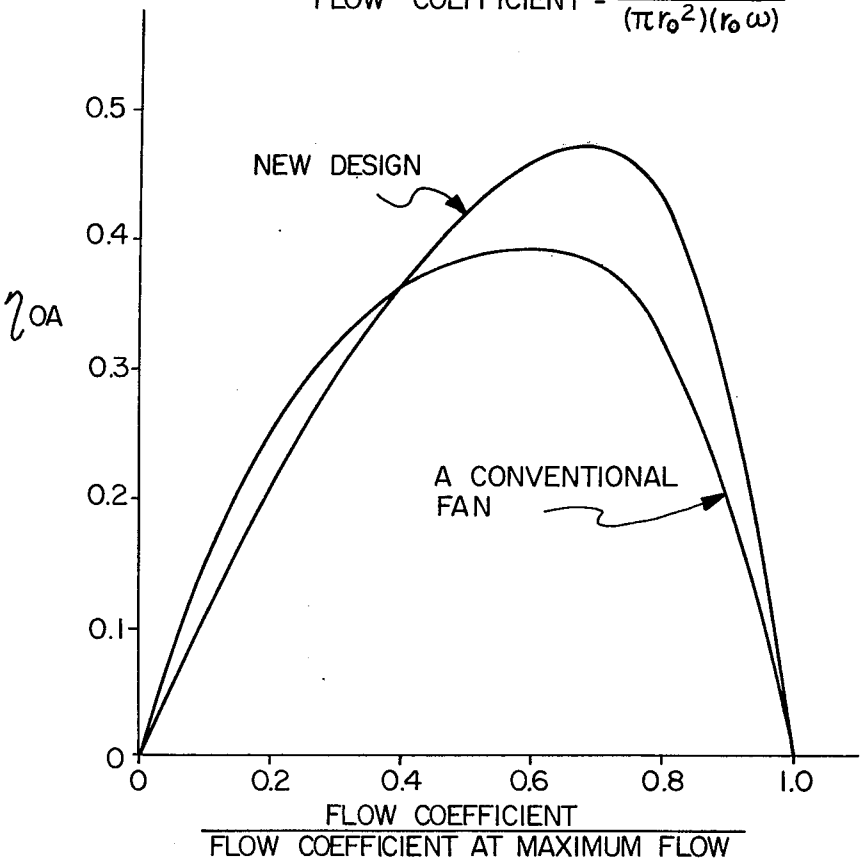
FIG. 6 — EXPERIENTAL PROOF OF FAN OVERALL EFFICIENCY IMPROVEMENT USING THE NEW DESIGN
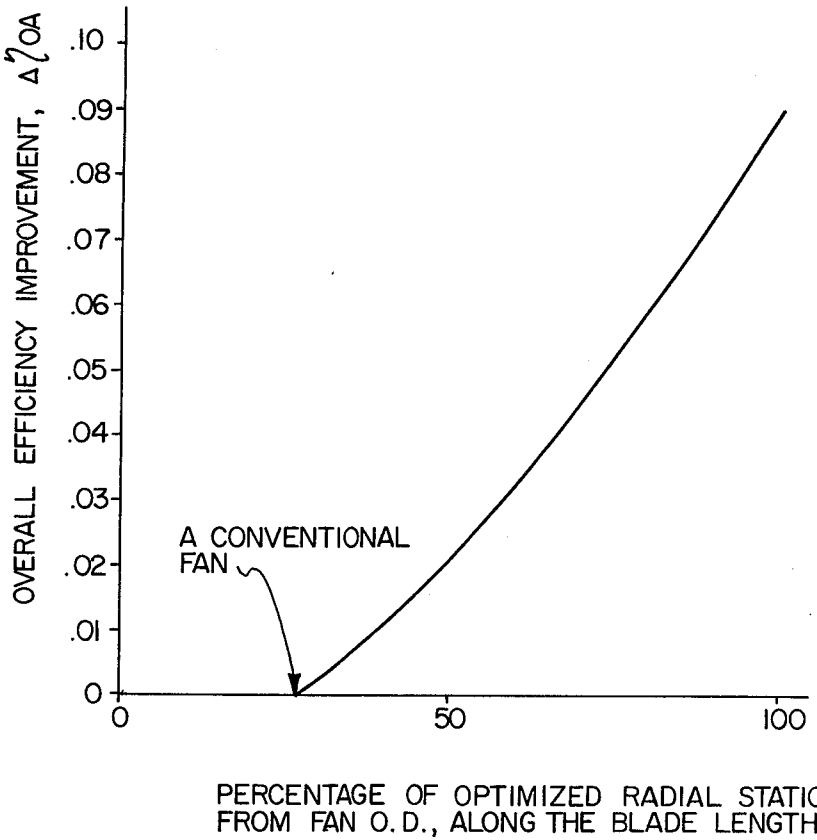

SAMPLE TWO-DIMENSIONAL WIND TUNNEL TEST DATA OF CIRCULAR CAMBERED SHEET-METAL PLATES

SHEET METAL FAN

BACKGROUND OF THE INVENTION

It is known that properly twisting a blade of a turbomachine rotor such as a compressor, turbine, fan, pump, etc., improved performance and efficiency can be obtained. However, optimizing a blade section design has generally required extensive aerodynamic test data from wind tunnel and engineering design time. The manufacturing cost of a so-designed sheet-metal fan thereof has generally been prohibitive, particularly in automotive applications. The current energy shortages and noise regulations have led the automotive industry and other sheet metal fan users to consider more efficient and often more expensive fans which consume less energy and generate less noise.

SUMMARY OF THE INVENTION

This invention is directed to a twisted type sheet-metal fan of relatively simple geometry and of relatively low manufacturing cost to provide an aerodynamically optimized fan having particular utility in automotive cooling fan applications at a competitive cost level.

More particularly, the invention may be defined as a sheet-metal fan blade of improved performance and efficiency wherein the camber angle $\theta$ and the chord angle $\gamma$ are so varied along radial positions of the blade that the angles of attack along at least 70% of the radial length of the blade is not less than 2° more than 10° and preferably between 3° and 8° whereby the energy input to the fan blade at any radial position is equal to $K_H(r^n)$ wherein $n$ is between 1 and 2.

IN THE DRAWINGS

FIG. 1 is a fragmentary front view of a typical automotive cooling fan of sheet metal constructed according to the teachings of this invention;

FIG. 2 is a cross-sectional view of a plurality of adjacent fan blade sections taken along line 2—2 of FIG. 1 at a typical radial station *r;*

Figure 3A:
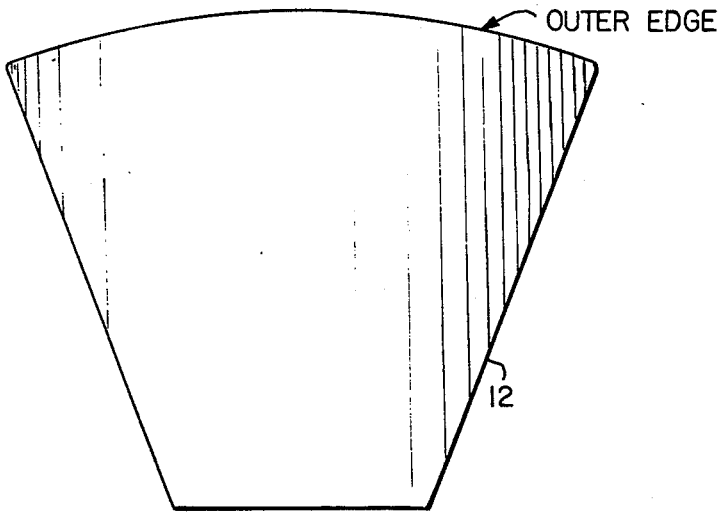
Figure 3B:
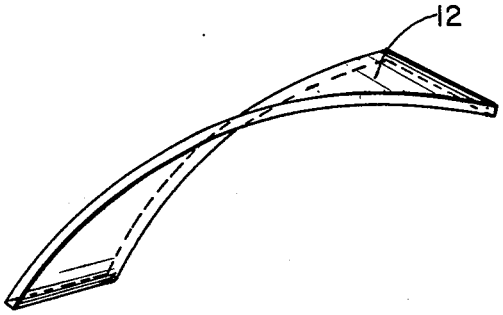

FIG. 3*a* is a front view of a fan blade of the type shown in FIG. 1 wherein an exponent $n$ approximately equals to 2;

FIG. 3*b* is an end view of the blade shown in FIG. 3*a;*

Figure 4A:
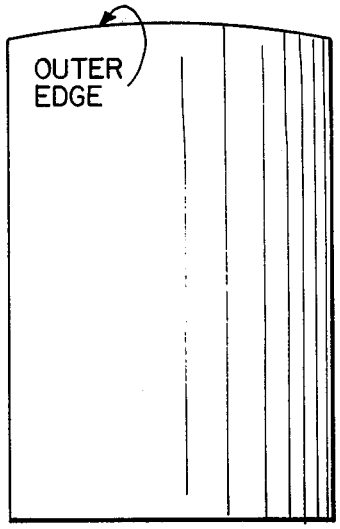
PRIOR ART FIG. 4a
Figure 4B:
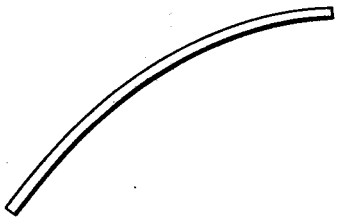
PRIOR ART FIG. 4b

FIG. 4*a* is a view similar to FIG. 3*a* but of a conventional automotive cooling fan blade;

FIG. 4*b* is an end view of the blade shown in FIG. 4*a;*

FIG. 5 illustrates test comparison of the efficiencies of the fans illustrated in FIGS. 3*a* and 3*b* and 4*a* and 4*b;*

FIG. 6 shows the improvement of overall fan efficiency as a function of the number of radial stations optimized according to the teachings of this invention.

Figure 7:
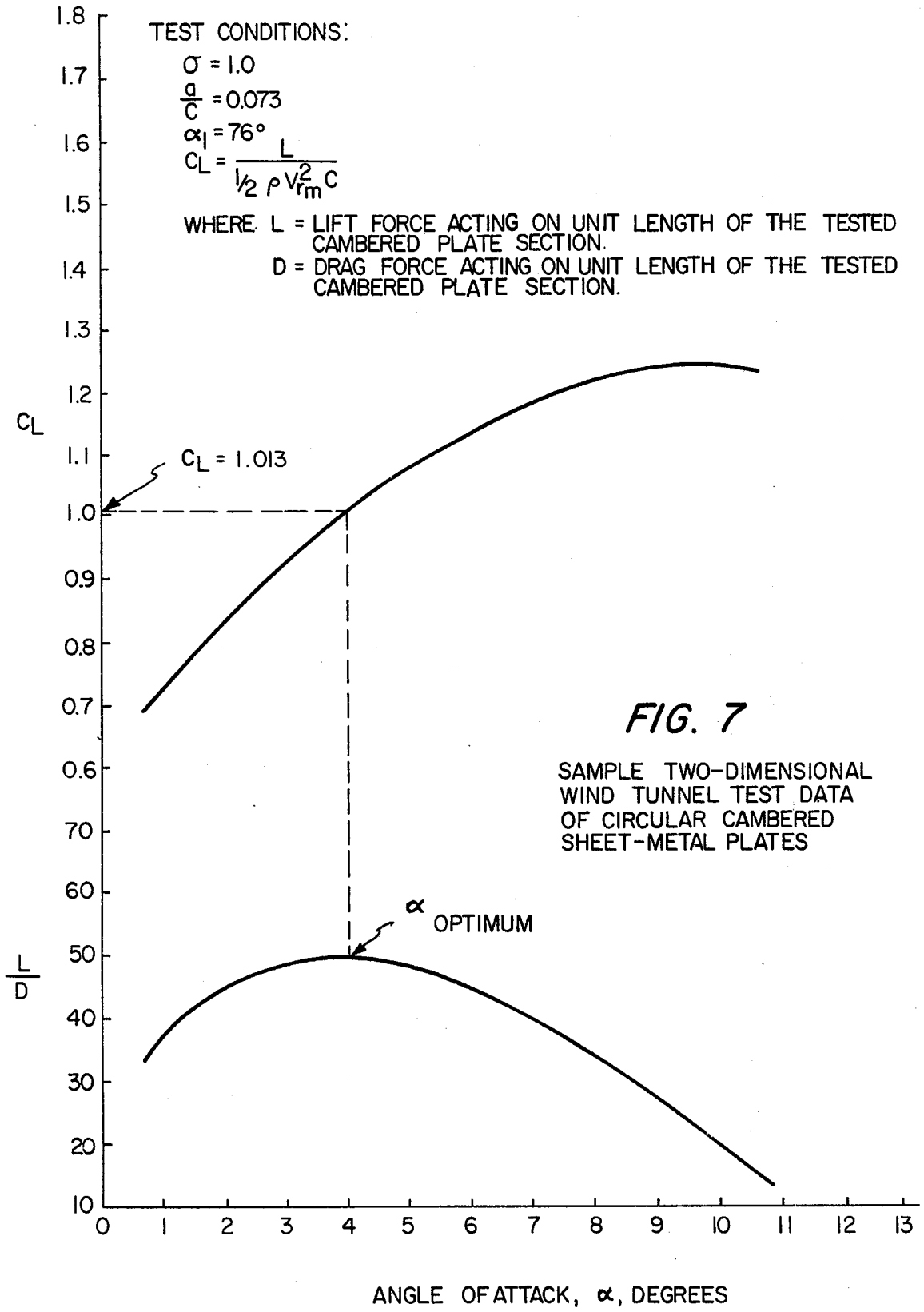

FIG. 7 illustrates a typical set of curves for the indicated test conditions which are experimentally determined by known techniques, from two-dimensional wind tunnel testing of circular, cambered sheet metal plates. As the indicated test conditions vary, an entirely new set of curves will, in general, be generated.

DETAILED DESCRIPTION OF THE INVENTION

A fan is a device for transferring energy to air. Energy must be transferred to each air particle in front of the fan to cause this particle to move to the rear of the fan. The fundamental equation, known as Euler's equation, which governs the energy transferred to an air stream across a moving blade section can be written as:

$\Delta H_{TH}$ = Theoretical energy transfer per unit mass of air at a given fan radial station r, as shown in FIG. 2 in an annular flow passage $$= \frac{(r\omega)Vu_2}{g} \tag{1}$$

An overall energy balance through the annular flow passage of a typical fan in an incompressible flow field can be written as:

$$\int_{r_i}^{r_o} [\rho V_1(2\pi r)] (\Delta H_{TH})\, dr = \frac{\int_{r_i}^{r_o} [\rho V_1(2\pi r)dr] \left(\frac{\Delta p}{\rho g}\right)}{\eta_{oa}} \tag{2}$$

Where:

$\rho$ = Density of air $r_i$ = Fan blade inner radius $r_o$ = Fan blade outer radius $\Delta p$ = Average pressure rise across the fan, i.e., from in front of the fan to the rear of the fan.

$\eta_{oa}$ = Overall fan efficiency $V_1$ = Average axial air velocity at fan inlet $g$ = Gravitational acceleration It has been found from extensive tests that fans designed using the following equation provide the best engine radiator cooling performance: (from equations (1) and (2))

$$\Delta H_{TH} = K_H(r^n) \tag{3}$$

Where: $n$ = a design constant greater than 1 but less than 2.

$$K_H = \left(\frac{\Delta p}{\rho g}\right)\left(\frac{1}{\eta_{oa}}\right)\frac{(n+2)(r_o^2 - r_i^2)}{2[r_o^{(n+2)} - r_i^{(n+2)}]} \tag{4}$$

EXAMPLE

The following design example is given to demonstrate the construction and also the manner of making the fan blade of this invention.

The design calculations were done by a computer in view of the numerous iterations and large aerodynamic data bank involved and the following presents only the results of the final iteration. The example is done for the fan 10 of FIG. 1 having six blades 12, a combined hub and spider 14 and an overall fan efficiency ($\eta_{oa}$) of 45%. This example is for a fan designed to meet the following conditions:

$r_o$ = 14 inches $r_i$ = 4.66 inches $R_F$ = 18 inches $\rho g$ = 0.075 $lb_m/ft^3$ $Q$ = 10,000 $ft^3$/min.

$N$ = Speed of rotation = 2,100 rpm $\Delta p$ = 3.5 inches of water = 18.2 $lb_f/ft^2$ The exponent $n$ in equation (3) was chosen to be 1.7. Therefore, substituting into equation (4), $$K_H = \left(\frac{18.2}{.075}\right)\left(\frac{1}{.45}\right)\frac{(1.7+2)(14^2 - 4.66^2)}{2(14^{3.7} - 4.66^{3.7})}$$

$$= 10.164$$

-continued $$V_1 = \frac{\text{volumetric flow}}{\text{area}} = \frac{Q}{\pi(r_o^2 - r_1^2)} = \frac{\frac{10{,}000}{60}}{\frac{\pi(14^2 - 4.66^2)}{144}} = 43.833 \text{ ft/sec}$$

$$\omega = \frac{\pi(N)}{30} = \frac{\pi(2{,}100)}{30} = 219.91 \text{ rad/sec}$$

These values hold for all radial stations of each blade 12. For a typical blade section, for example, at $r = 9.86$ inches, (see FIG. 1), the detailed aerodynamic calculations are as follows:

From Eq. (3) $\Delta H_{TH} = (10.164)(9.86)^{1.7} = 497.36 \frac{\text{ft-lb}_f}{\text{lb}_m}$ (where $\text{lb}_f$ = pounds of force and $\text{lb}_m$ = pounds of mass)

From Eq. (1) $V_{u_2} = \frac{497.36(32.2)}{\frac{(9.86)(219.91)}{12}} = 88.63$ ft/sec Also, $U = r\omega = \left(\frac{9.86}{12}\right)(219.91) = 180.69$ ft/sec $$\alpha_1 = \tan^{-1}\left(\frac{U}{V_1}\right) = \tan^{-1}\left(\frac{180.69}{43.833}\right) = 76.36°$$

$$\alpha_2 = \tan^{-1}\left(\frac{U - V_{u_2}}{V_1}\right) = \tan^{-1}\left(\frac{180.69 - 88.63}{43.833}\right) = 64.54°$$

$$\phi_r = \tan^{-1}\left(\frac{V_1}{U - \frac{V_{u_2}}{2}}\right) = \tan^{-1}\left(\frac{43.833}{180.69 - \frac{88.63}{2}}\right) = 17.82°$$

The reader will note that these last three values are vectorially (by trigonometry) determined from FIG. 2.

Across a rotating blade row, such as the row of FIG. 2, (static pressure rise) = $\eta_R x$ (reduction of relative dynamic pressure)

Where $\eta_R$ = channel efficiency of a rotating blade passage. The known aerodynamic "blade loading" equation is $$C_L\sigma = 2\left(\frac{V_{u_2}}{V_1}\right)\sin\phi_r - \sigma C_D \cot\phi_r \quad (5)$$

where $C_D$ = blade drag coefficient.

The term $\sigma C_D \cot\phi_r$ in equation (5) can be rewritten as:

$$\sigma C_D \cot\phi_r = \frac{V_{u_2}}{V_1}\left(\frac{U}{V_1} - \frac{1}{2}\frac{V_{u_2}}{V_1}\right)(1 - \eta_R)\sin\phi_r \sin 2\phi_r \quad (6)$$

Hence, $$C_L\sigma = 2\left(\frac{V_{u_2}}{V_1}\right)\sin\phi_r\left[1 - \left(\frac{U}{V_1} - \frac{1}{2}\frac{V_{u_2}}{V_1}\right)(1 - \eta_R)\frac{\sin 2\phi_r}{2}\right]$$

It is known that for sheet-metal fan blades an optimum value for $\eta_R$ in equation (6) would be 0.8.

Now, substituting numerical values into equation (6), $$C_L\sigma = 2\left(\frac{88.63}{43.833}\right)\sin 17.82°\left[1 - \left(\frac{180.69}{43.833} - \frac{1}{2}\frac{88.63}{43.833}\right)(1 - 0.8)\frac{\sin 2(17.82°)}{2}\right] = 1.013$$

The iteration process starts from here to select a blade cross-sectional configuration at the chosen radial station (r=9.86 in.) which will satisfy $C_L\sigma = 1.013$. Firstly, a trial value of C greater than zero is selected, and calculations are made to obtain $\theta$, $\sigma$ and $a/C$. Next, FIG. 7 is employed to obtain $C_L$, and then $C_L\sigma$ is calculated. These four variables are repeatedly calculated until the value of $C_L\sigma$ obtained by equation (6) is equal to the value of $C_L\sigma$ obtained by the use of test data such as that shown at FIG. 7. The final iteration results are as follows:

C (the chord length, see FIG. 2) was found to be 10.33 inches and all of the remaining geometrical parameters of a circular cambered plate blade can be calculated as follows:

$$\theta = 2\sin^{-1}\left(\frac{C}{2R_F}\right) = 2\sin^{-1}\left[\frac{10.33}{2(18)}\right] = 33.35°$$

$$\sigma = \frac{(\text{No. of Blades})(C)}{2\pi R} = \frac{6(10.33)}{2\pi(9.86)} = 1.001$$

$$\frac{a}{C} = \frac{1 - \cos\frac{\theta}{2}}{2\sin\frac{\theta}{2}} = \frac{1 - \cos\frac{33.35°}{2}}{2\sin\frac{33.35°}{2}} = 0.073$$

$(C_L)$ at $\alpha_{optimum}$ = 1.013 (From FIG. 7)

$\alpha = \alpha_{optimum} = 4°$

Since $(C_L)$ at $\alpha_{optimum} = C_L\sigma/\sigma = 1.013$, the selection of a desired geometry is complete. The blade chord angle $\gamma = \phi_r + \alpha = 17.82° + 4° = 21.82°$ Calculations, similar to the above calculations for a radial station $r = 9.86$ inches, were carried out at various radial stations over at least 70% of the blade length. The final fan geometry is tabulated and compared with the geometry of a conventional fan as follows:

1. OVERALL PERFORMANCE AND DESIGN CONDITIONS:

| | Fan Designed Using New Method | Conventional Fan |
|---|---|---|
| Q, CFM | 10,000 | 10,000 |
| N, RPM | 2,100 | 2,100 |
| Δp, in. $H_2O$ | 3.5 | 3.5 |
| $r_o$, in. | 14 | 14 |
| $r_i$, in. | 4.66 | 4.66 |
| Σg, $\text{lb}_m/\text{ft}^3$ | 0.075 | 0.075 |
| $R_F$, in. | 18 | 6 |
| ηoa | 0.45 | 0.375 |

2. DETAIL GEOMETRY

| | Fan Designed Using New Method | | Conventional Fan | |
|---|---|---|---|---|
| r, in. | C, in. | γ° | C, in. | γ° |
| 14 | 13.11 | 15.06 | 5.5 | 28 |
| 13.07 | 12.49 | 16.61 | ↑ | ↑ |
| 12.13 | 11.87 | 18.17 | ↑ | ↑ |
| 11.20 | 11.24 | 19.72 | ↑ | ↑ |
| 9.86 | 10.33 | 21.82 | ↑ | ↑ |
| 8.40 | 9.33 | 24.38 | ↑ | ↑ |
| 7.46 | 8.69 | 25.93 | ↑ | ↑ |
| 6.53 | 8.04 | 27.48 | ↑ | ↑ |
| 5.59 | 7.40 | 29.03 | ↑ | ↑ |

-continued

| 2. DETAIL GEOMETRY | | | | |
|---|---|---|---|---|
| | Fan Designed Using New Method | | Conventional Fan | |
| r, in. | C, in. | γ° | C, in. | γ° |
| 4.66 | 6.75 | 30.59 | 5.5 | 28 |

PW = C sinγ= Projected Width

The results of test on a fan constructed as set forth in the example, as compared with a conventional sheet-metal blade as shown in FIGS. 4*a* and 4*b*, are illustrated in FIGS. 5 and 6.

We claim:

1. A rotating fan comprising, in combination:

(a) a hub secured to and rotated by a rotary shaft;

(b) a plurality of sheet metal fan blades fixed in spaced circumferential relation to said hub and projecting radially therefrom; each fan blade having a leading edge and a trailing edge defining a chord length C therebetween, and a forming radius of curvature at each radial station $r$ which establishes with said chord length C a camber angle $\theta$ and a chord angle $\gamma$ at each such station; and each fan blade having its chord angle and its camber angle varied over its radial length such that the theoretical energy transfer $\Delta H_{TH}$ per unit mass of air at each radial station $r$ is equal to $K_H(r^N)$ over at least 70% of its radial length, where $n$ is a constant greater than 1 but less than 2 and $$K_H = \left(\frac{\Delta p}{\rho g}\right)\left(\frac{1}{\eta_{oa}}\right)\frac{(n+2)(r_o^2 - r_i^2)}{2[r_o^{(n+2)} - r_i^{(n+2)}]}$$

in which:

$\rho$ = density of air $r_i$ = fan blade inner radius $r_o$ = fan blade outer radius $\Delta p$ = average pressure rise across the fan $\eta_{oa}$ = overall fan efficiency $g$ = gravitational acceleration.

* * * * *